US006667672B2

(12) United States Patent
Fowler

(10) Patent No.: US 6,667,672 B2
(45) Date of Patent: Dec. 23, 2003

(54) COMPACT HIGH POWER ANALOG ELECTRICALLY CONTROLLED PHASE SHIFTER

(75) Inventor: Wayne Dean Fowler, Burlington, MA (US)

(73) Assignee: M/A-Com, Inc., Lowell, MA (US)

( * ) Notice: Subject to any disclaimer, the term of this patent is extended or adjusted under 35 U.S.C. 154(b) by 16 days.

(21) Appl. No.: 10/151,830

(22) Filed: May 21, 2002

(65) Prior Publication Data

US 2002/0190813 A1 Dec. 19, 2002

Related U.S. Application Data

(60) Provisional application No. 60/298,277, filed on Jun. 14, 2001.

(51) Int. Cl.[7] ..... H01P 1/18; H01P 3/00

(52) U.S. Cl. ..... 333/158; 333/24.1; 333/24.2; 333/147; 333/148; 333/158; 333/162; 333/125; 333/202; 333/238; 428/692; 428/693; 428/700

(58) Field of Search ..... 333/24.1, 24.2, 333/147, 148, 162, 158, 238, 202, 125; 428/692, 693, 700

(56) References Cited

U.S. PATENT DOCUMENTS

| | | | | |
|---|---|---|---|---|
| 3,555,463 A | | 1/1971 | Ogasawara et al. | 333/31 |
| 3,654,576 A | | 4/1972 | Buck | 333/31 A |
| 3,698,008 A | * | 10/1972 | Roberts et al. | 333/158 |
| 3,747,031 A | * | 7/1973 | Ohm | 333/81 B |
| 3,760,300 A | * | 9/1973 | Leahy | 333/158 |
| 4,467,292 A | * | 8/1984 | Ajioka et al. | 333/24.1 |
| 4,682,126 A | * | 7/1987 | Milberger et al. | 333/81 B |
| 4,887,054 A | * | 12/1989 | Stern et al. | 333/158 |
| 4,956,614 A | * | 9/1990 | Baril | 330/286 |
| 5,013,997 A | * | 5/1991 | Reese | 323/212 |
| 5,440,278 A | * | 8/1995 | Bartholomew | 332/103 |
| 5,828,271 A | * | 10/1998 | Stitzer | 333/24.1 |
| 6,377,133 B1 | * | 4/2002 | Ihmels et al. | 333/158 |

OTHER PUBLICATIONS

International Search Report, Applicant's file reference, 17694 PCT, International application No. PCT/US 02/18338, International filing dated Oct. 6, 2002.

* cited by examiner

*Primary Examiner*—Michael Tokar
*Assistant Examiner*—Linh Van Nguyen

(57) ABSTRACT

A high power ferrite microwave phase shifter that is both compact and low cost. The ferrite phase shifter includes a waveguide having a first cylinder and a second cylinder, the radius of the second cylinder being less than the radius of the first cylinder. The second cylinder is disposed within the first cylinder such that the two cylinders have a common axis of symmetry. The waveguide includes a first septum formed as a disk and disposed within the second cylinder. The disk has a pie-shaped aperture formed therethrough and is centrally disposed within the second cylinder so that the two cylinders and the disk share the same axis of symmetry. The second cylinder has an opening formed therethrough that is aligned with the pie-shaped aperture. The waveguide further includes a second septum that extends from the first cylinder to the disk center while bisecting the pie-shaped aperture, thereby separating an input from an output of the ferrite phase shifter. The waveguide is loaded with ferrite and a magnetic field is applied to the ferrite for controllably shifting the phase of signals propagating through the ferrite phase shifter device.

10 Claims, 5 Drawing Sheets

COMPACT HIGH POWER ANALOG ELECTRICALLY CONTROLLED PHASE SHIFTER

CROSS REFERENCE TO RELATED APPLICATIONS

This application claims priority of U.S. Provisional Patent Application No. 60/298,277 filed Jun. 14, 2001 entitled COMPACT HIGH POWER ANALOG ELECTRICALLY CONTROLLED PHASE SHIFTER.

STATEMENT REGARDING FEDERALLY SPONSORED RESEARCH OR DEVELOPMENT

N/A

BACKGROUND OF THE INVENTION

The present invention relates generally to analog phase shifters, and more specifically to high power ferrite microwave phase shifters.

Ferrite phase shifters are known that employ an applied magnetic field to vary the permeability of ferrite, thereby controlling the velocity and thus the phase shift of signals propagating through the phase shifter device. A conventional ferrite phase shifter comprises a rectangular waveguide structure, a ferrite slab loading and at least partially filling the waveguide, and a coil of wire wrapped around the waveguide. The wire coil is configured to carry a variable control current for generating a magnetic field, which is transversely applied to the ferrite slab to shift the phase of signals propagating in the rectangular waveguide structure.

One shortcoming of the conventional ferrite phase shifter is that the phase shifter device can become rather large and bulky when configured to carry lower frequency microwave signals. Such large bulky ferrite microwave phase shifters can also be costly to manufacture and thus not amenable to high volume production processes.

It would therefore be desirable to have a more compact ferrite phase shifter for handling microwave signals. Such a ferrite microwave phase shifter would be low cost and suitable for manufacturing in high volume production processes. It would also be desirable to have a compact ferrite microwave phase shifter that can be used in high power applications.

BRIEF SUMMARY OF THE INVENTION

In accordance with the present invention, a high power ferrite microwave phase shifter is provided that is both compact and low cost. Benefits of the presently disclosed invention are achieved by providing a waveguide structure that not only reduces the size of the phase shifter device, but also enhances the effectiveness of applied Radio Frequency (RF) magnetic fields.

In one embodiment, the high power ferrite microwave phase shifter comprises a waveguide structure including a first substantially cylindrical element and a second substantially cylindrical element, in which the radius of the second cylinder is less than the radius of the first cylinder. The second cylindrical element is disposed within the first cylindrical element such that the first and second cylinders have a common axis of symmetry. The waveguide structure further includes a first septum formed as a disk and disposed within the second cylinder. The disk has a pie-shaped aperture formed therethrough that extends through the circumference of the disk and tapers to the disk center. The disk is centrally disposed within the second cylindrical element such that the first cylinder, the second cylinder, and the disk share the same axis of symmetry. The second cylinder has an opening formed therethrough that extends the full length of the second cylinder. The inner wall of the second cylinder is coupled to the circumferential edge of the disk such that the opening in the second cylinder is aligned with the pie-shaped aperture in the disk. The second cylinder is thus coupled to the disk without obstructing the pie-shaped aperture. The waveguide structure further includes a second planar septum that extends from the inner wall of the first cylinder to the disk center while bisecting the pie-shaped disk aperture. The second septum is coupled to the inner wall of the first cylinder and the disk at the disk center such that the second septum is approximately perpendicular to the plane of the disk.

In a preferred embodiment, the ferrite microwave phase shifter is loaded and totally filled with ferrite. The ferrite microwave phase shifter includes a coil of wire wrapped around the circumference of the first cylinder and configured to carry a variable control current for generating an RF magnetic field, which is transversely applied to the ferrite for controllably shifting the phase of signals propagating in the compact waveguide structure.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

U.S. Provisional Patent Application No. 60/298,277 filed Jun. 14, 2001 is incorporated herein by reference.

A high power ferrite microwave phase shifter is disclosed that has both a reduced size and a reduced cost of manufacture. The presently disclosed ferrite microwave phase shifter incorporates a waveguide structure that reduces the size of the phase shifter device while enhancing the effectiveness of applied Radio Frequency (RF) magnetic fields.

Figure 1A:
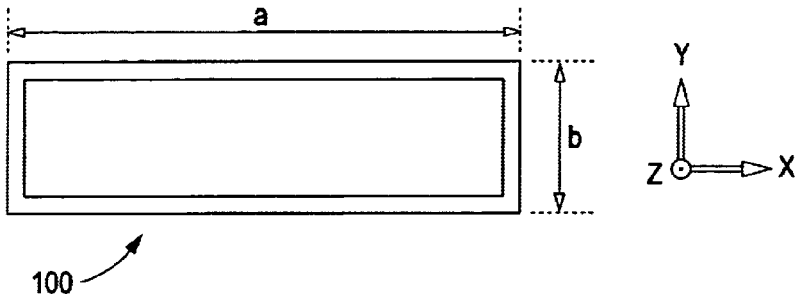
FIGS. 1*a*–1*c* are end and cross-sectional views of a rectangular waveguide structure illustrating the evolution of the present invention.

FIGS. 1*a*–1*c*, 2*a*–2*b*, and 3*a*–3*b* depict the evolution of the presently disclosed ferrite microwave phase shifter. Specifically, FIG. 1*a* depicts an illustrative embodiment of a rectangular waveguide 100 having a rectangular cross-section in the x-y plane. It should be understood that the rectangular waveguide 100 extends longitudinally along the z-axis, which defines the propagation direction of RF energy in the guide. The rectangular waveguide 100 also has a longer transverse dimension along the x-axis defining its width "a", and a shorter transverse dimension along the y-axis defining its height "b".

Those of ordinary skill in this art will appreciate that a rectangular waveguide such as the rectangular waveguide 100 normally has an aspect ratio of 2:1. Further, the rectangular waveguide 100 with a 2:1 aspect ratio has an associated cutoff wavelength λc equal to twice the width of the guide, i.e., λc=2a.

Figure 1B:
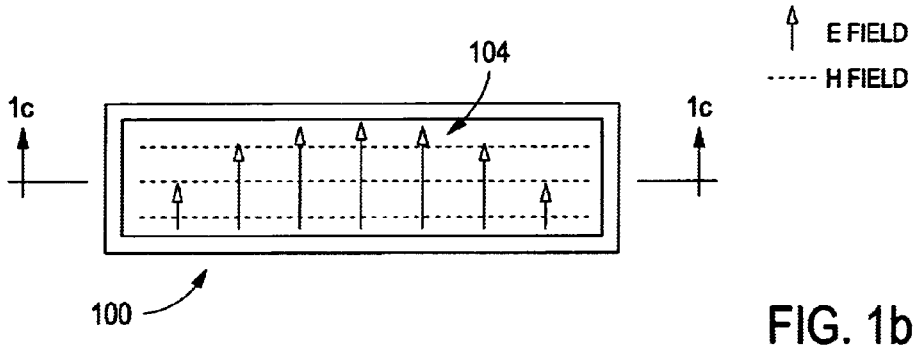

FIG. 1*b* depicts an RF propagation mode 104 for the rectangular waveguide 100, which is configured to conduct RF energy. In the illustrated embodiment, the RF propagation mode 104 is the $TE_{10}$ or dominant mode of the rectangular guide 100. According to the RF propagation mode 104, both an electric (E) field and a magnetic (H) field exist inside the rectangular waveguide 100. The E field has force lines directed along the y-axis, and the H field has force lines orthogonal to the force lines of the E field. Further, the amplitude of the E field is maximum at the center of the rectangular waveguide 100 and decreases upon approaching the short sides of the guide.

Figure 1C:
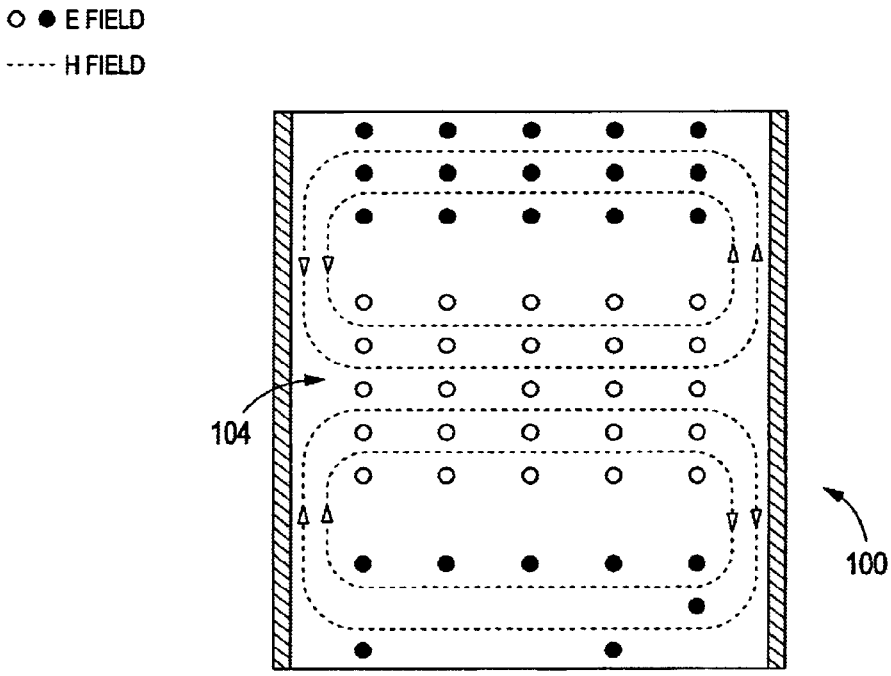

FIG. 1*c* is a cross-sectional view of the rectangular waveguide 100 along a line 1*c*—1*c* further depicting the RF propagation mode 104 for the guide. Specifically, FIG. 1*c* depicts the circular polarization of the H field inside the rectangular waveguide 100.

Figure 2A:
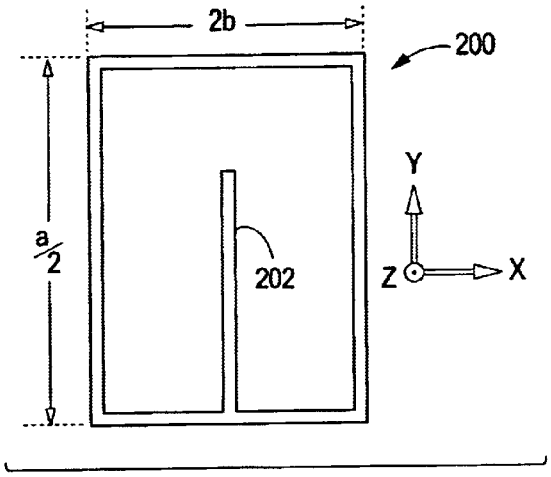
FIGS. 2*a*–2*b* are end views of a folded rectangular waveguide structure further illustrating the evolution of the present invention.

FIG. 2*a* depicts an illustrative embodiment of a folded rectangular waveguide 200. For example, the folded rectangular waveguide 200 may be formed by conceptually folding the longer transverse dimension of the rectangular waveguide 100 (see FIG. 1*a*) back on itself. In the illustrated embodiment, the folded rectangular waveguide 200 has a rectangular cross-section in the x-y plane, a longer transverse dimension measuring a/2 along the y-axis, and a shorter transverse dimension measuring 2b along the x-axis. Further, the rectangular waveguide 200 has a septum 202 coupled to one of the short sides of the guide and extending in the center of the guide along the y-axis. Like the rectangular waveguide 100 (see FIG. 1*a*), the folded rectangular waveguide 200 including the septum 202 extends longitudinally along the z-axis, which defines the propagation direction of RF energy in the guide. Moreover, the folded rectangular waveguide 200 has an associated cutoff wavelength λc equal to 2a, which is four times the longer transverse dimension a/2 of the guide. It is noted that by conceptually folding the rectangular waveguide 100 (see FIG. 1*a*) to form the folded waveguide structure 200, as described above, at least one of the dimensions of the rectangular waveguide 100 decreases in size by about 50%.

Figure 2B:
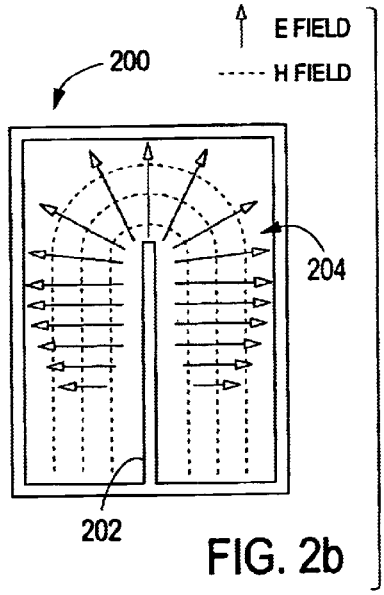

FIG. 2*b* is an end view of the folded rectangular waveguide 200 depicting an RF propagation mode 204 for the guide, which is configured to conduct RF energy. As shown in FIG. 2*b*, the RF propagation mode 204 is folded about the septum 202. According to this RF propagation mode 204, both an E field and an H field exist inside the guide 200. The E field has force lines emanating from the septum 202, and the H field has force lines orthogonal to the force lines of the E field. Further, the amplitude of the E field is maximum at the center of the guide parallel to the y-axis and decreases upon approaching the short side of the guide at the base of the septum 202. It should be understood that the H field inside the folded rectangular waveguide 200 has a circular polarization like the H field inside the rectangular waveguide 100 (see FIG. 1*c*).

Figure 3A:
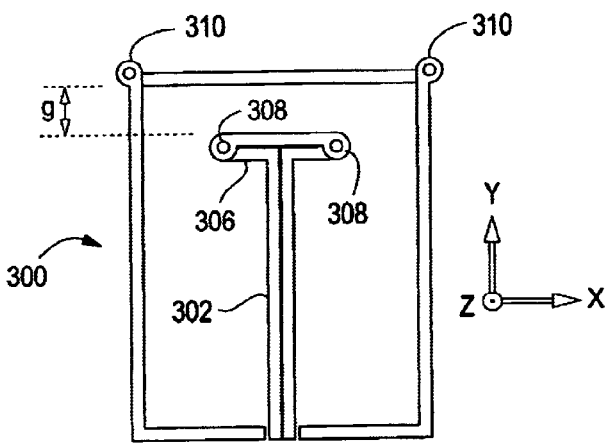
FIGS. 3*a*–3*b* are end views of ridge waveguide structures further illustrating the evolution of the present invention.

FIG. 3*a* depicts an illustrative embodiment of another folded rectangular waveguide 300. It is noted that the folded rectangular waveguide structure 300 is like the folded rectangular waveguide structure 200 (see FIG. 2*a*) except that the folded rectangular waveguide 300 includes a crosspiece 306 perpendicularly coupled to a septum 302 to form a "T". Both the septum 302 and the crosspiece 306 extend coextensively along the z-axis. The crosspiece 306 is configured to increase the current carrying area of the rectangular waveguide 300 and thus reduce losses. Including the crosspiece 306 in the folded rectangular waveguide 300 also increases the capacitance at the center of the guide and decreases the inductance at side sections of the guide, thereby reducing the effective impedance of the guide. As a result, the impedance of the folded rectangular waveguide 300 can be brought closer to 50Ω to facilitate impedance matching between the guide and a standard coaxial connector.

Figure 3B:
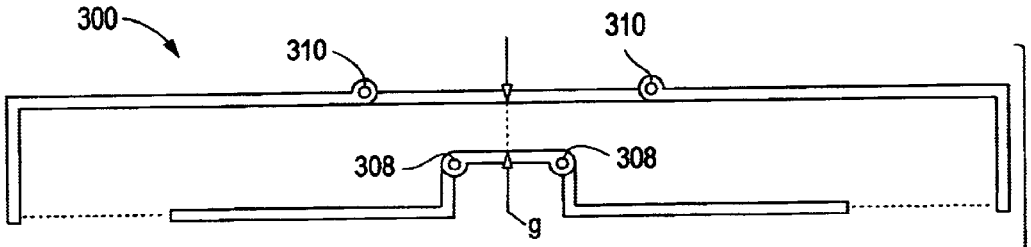

Moreover, including the crosspiece 306 in the folded rectangular waveguide 300 causes the performance of the guide to be similar to the performance of a ridge waveguide. For example, the rectangular waveguide structure 300 can be modified to approximate a ridge waveguide by conceptually inserting hinges 308 at opposing ends of the crosspiece 306, and conceptually inserting hinges 310 at respective corners of the guide near the hinges 308. Next, the rectangular waveguide 300 can be conceptually unfolded at the hinges 308 and 310 to achieve a single-ridge waveguide structure, as depicted in FIG. 3*b*. It is noted that the cutoff wavelength λc associated with the single-ridge waveguide structure can be increased and the effective impedance of the ridge waveguide can be reduced by decreasing a gap width g (see FIG. 3*b*) of the ridge waveguide. It follows that a corresponding cutoff wavelength λc and a corresponding effective impedance of the folded rectangular waveguide 300 can be similarly adjusted by decreasing the gap width g (see FIG. 3*a*) between the crosspiece 306 and the adjacent short side of the guide. It should be understood that the RF propagation mode (not shown) inside the folded rectangular waveguide 300 is like the RF propagation mode 204 (see FIG. 2*b*) inside the folded rectangular waveguide 200.

Figure 4A:
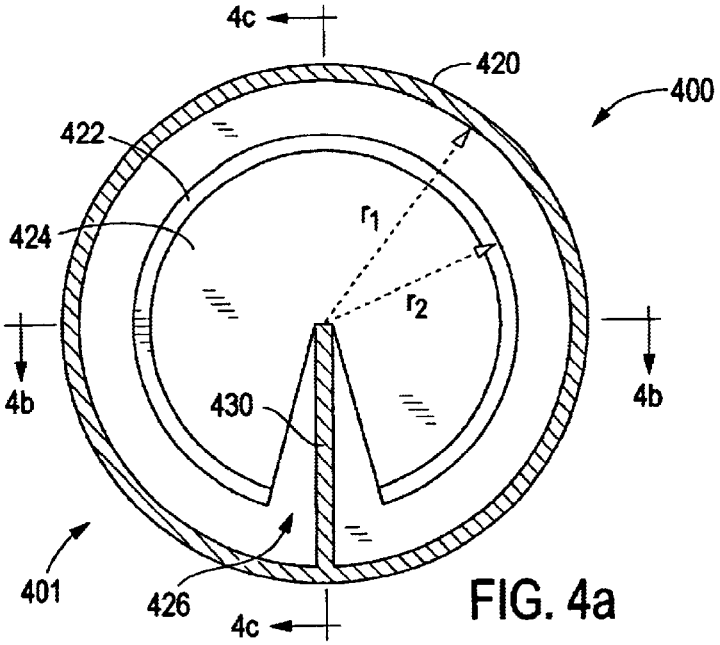
FIGS. 4*a*–4*e* are plan, cross-sectional, and perspective views of a high power ferrite microwave phase shifter including a waveguide structure according to the present invention.
Figure 4B:
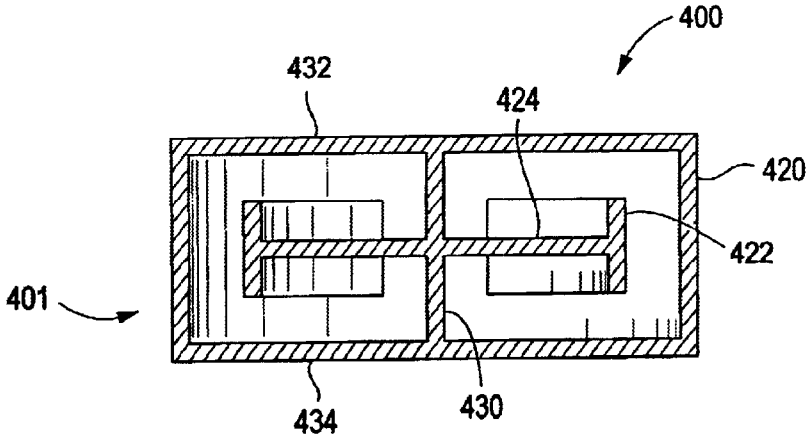
Figure 4C:
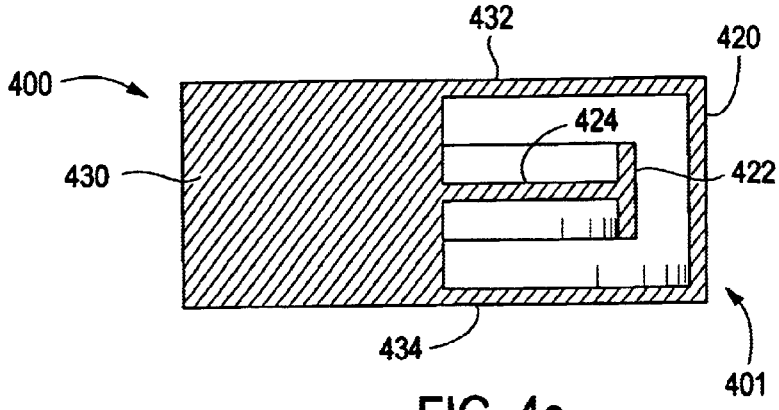
Figure 4D:
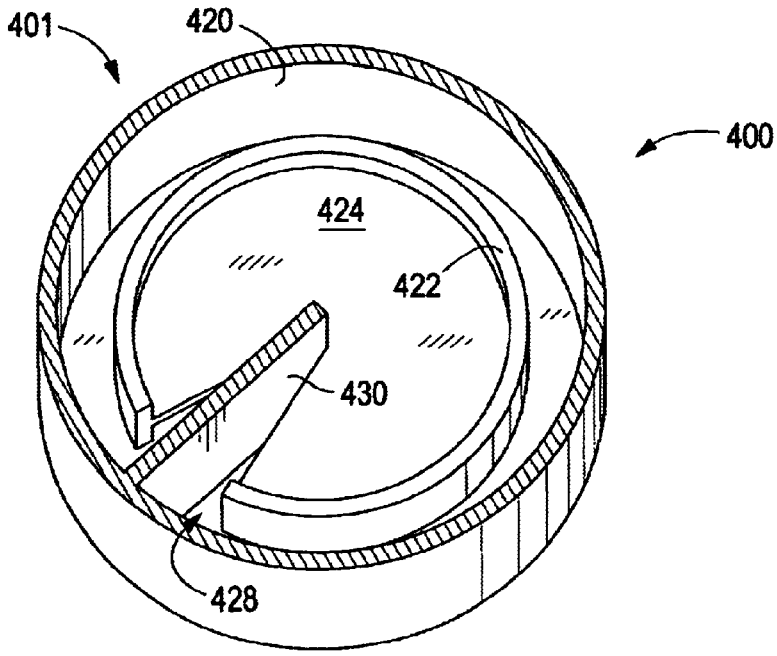
Figure 4E:
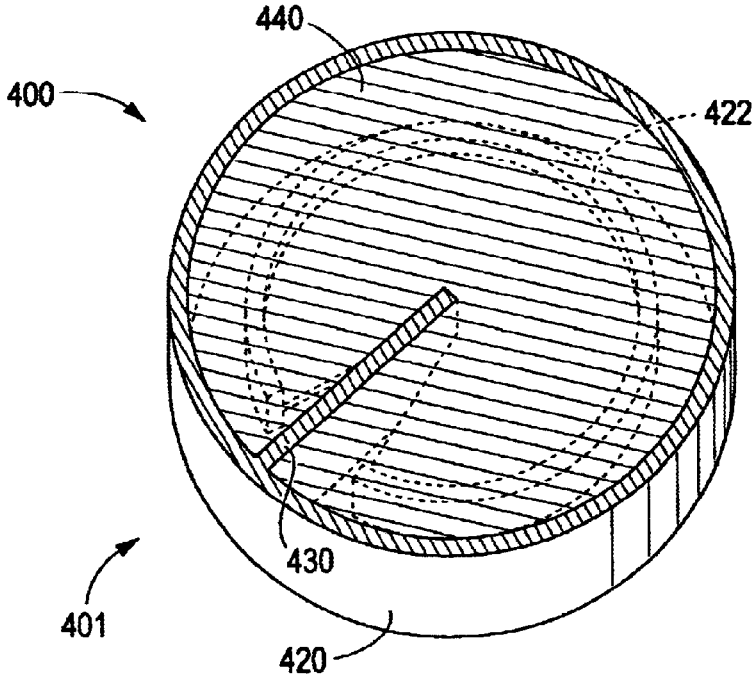

FIG. 4*a* depicts an illustrative embodiment of a ferrite microwave phase shifter 400, in accordance with the present invention. FIGS. 4*b*–4*c* depict cross-sectional views of the ferrite microwave phase shifter 400 along lines 4*b*—4*b* and 4*c*—4*c*, respectively, and FIGS. 4*d*–4*e* depict perspective views of the ferrite microwave phase shifter 400. In the illustrated embodiment, the ferrite microwave phase shifter 400 includes a waveguide 401 that may be formed by conceptually bending the folded rectangular waveguide 300 (see FIG. 3*a*) along the longitudinal dimension until opposing ends of the waveguide structure 300 meet.

As shown in FIGS. 4*a*–4*e*, the waveguide structure 401 includes a first substantially cylindrical element 420, a second substantially cylindrical element 422, a first septum 424, and a second septum 430. Specifically, the radius r2 of the second cylinder 422 is less than the radius r1 of the first cylinder 420. It is noted that the difference between the radii r1 and r2 generally corresponds to the gap width g of the folded rectangular waveguide 300 (see FIG. 3*a*). The second cylinder 422 is disposed within the first cylinder 420 such that the first and second cylinders 420 and 422 have a common axis of symmetry. The first septum 424 is formed as a disk and centrally disposed within the second cylinder 422 such that the first cylinder 420, the second cylinder 422, and the disk 424 share the same axis of symmetry. The disk 424 has a pie-shaped aperture 426 formed therethrough, which extends through the circumference of the disk 424 to the disk center. The second cylinder 422 also has an opening 428 (see FIG. 4*d*) formed therethrough that extends the full length of the cylinder. The inner wall of the second cylinder 422 is coupled to the circumferential edge of the disk 424 such that the opening 428 in the second cylinder 422 is aligned with the pie-shaped aperture 426 in the disk 424. The second cylinder 422 is thus coupled to the disk 424 so as not to obstruct the pie-shaped aperture 426. The second septum 430 of the waveguide structure 401 extends from the inner wall of the first cylinder 420 to the disk center while bisecting the pie-shaped disk aperture 426. The second septum 430 is coupled to both the inner wall of the first cylinder 420 and the disk 424 at the disk center, and is oriented to be approximately perpendicular to the plane of the disk 424. The second septum 430 is configured to separate an input of the waveguide 401 from an output of the guide.

It should be appreciated that the waveguide 401 is loaded and at least partially filled with ferrite. For example, the ferrite loading the waveguide structure 401 may comprise lithium ferrite or any other suitable ferrite material. In the preferred embodiment, the waveguide structure 401 is totally filled with ferrite 440, as shown in FIG. 4*e*. Further, the waveguide 401 includes cover portions 432 and 434 (see FIGS. 4*b*–4*c*) configured to enclose the ferrite 440 within the guide and thus complete the overall structure of the guide. It is noted that by totally filling the waveguide structure 401 with the ferrite 440, the size of the guide can be reduced by an amount proportional to the square root of the dielectric constant $\in_r$ of the ferrite material. For example, in the event the dielectric constant $\in_r$ of the ferrite 440 is equal to 14, the size of the guide 401 can be reduced by a factor of $(14)^{1/2}$ or about 3.75:1. Moreover, by totally filling the waveguide 401 with the ferrite 440, the maximum phase shift of signals propagating through the guide can be achieved.

It should also be appreciated that a magnetic field can be generated and applied to the ferrite 440 loading the waveguide 401 to vary the permeability of the ferrite 440, thereby controlling the velocity and thus the phase shift of signals propagating through the ferrite microwave phase shifter 400. In the presently disclosed embodiment, the ferrite microwave phase shifter 400 includes a coil of wire (not shown) wrapped around the circumference of the first cylinder 420. The wire coil is configured to carry a variable control current for generating the magnetic field, which is transversely applied to the ferrite 440. Specifically, the RF magnetic field is applied in line with the axis of symmetry of the first cylinder 420, the second cylinder 422, and the disk 424. It should be understood that the coil of wire is described above for purposes of illustration, and that alternative structures for electromagnetically generating the applied magnetic field may be employed. Further, in alternative embodiments, the magnetic field may be applied by one or more permanent magnets.

According to the RF propagation mode 104 for the rectangular waveguide 100 (see FIG. 1*a*), the H field inside the guide 100 has a circular polarization (see FIG. 1*c*). As shown in FIG. 1*c*, the circularly polarized H fields inside the guide 100 are in a "side-by-side" orientation. According to the RF propagation mode for the presently disclosed waveguide 401, the H field inside the guide 401 also has a circular polarization. However, because the RF propagation mode for the waveguide 401 is folded about the disk-shaped septum 424 much like the RF propagation mode 204 for the folded rectangular waveguide 200 (see FIG. 2*b*), circularly polarized H fields on opposite sides of the disk-shaped septum 424 inside the guide 401 are in a "back-to-back" orientation instead of the above-described side-by-side orientation. Because these back-to-back H fields have the same sense of circular polarization, the effectiveness of the RF magnetic field applied to the ferrite 440 for varying the ferrite permeability is enhanced.

The operation of the ferrite microwave phase shifter 400 will be better understood with reference to the following discussion. Ferrite material is characterized as having variable permeability. When in the presence of a biasing magnetic field, the iron content of the ferrite material is "stressed". Specifically, the spin of the iron atoms in the ferrite material is precessed by the biasing magnetic field. Further, an RF magnetic field applied to the ferrite material works either with or against this precession, thereby causing the permeability or inductive quality of the ferrite material to either increase or decrease.

Circularly polarized magnetic fields can be used to exploit this variable permeability characteristic of ferrite. For example, circularly polarized biasing magnetic fields can be generated to cause a circular precession that allows the maximum interaction between the spin of the iron atoms precessed by the biasing magnetic field and the atomic spin precessed by the applied RF magnetic field. The circularly polarized permeability of ferrite may be expressed as $$\mu+=1+\gamma Mo/(\gamma H\alpha-\omega) \quad (1)$$

$$\mu-=1+\gamma Mo/(\gamma H\alpha+\omega), \quad (2)$$

in which "γ" is the efficiency characteristic of the ferrite, "Mo" is the saturation characteristic of the ferrite, and "Hα" is the magnetic line width, which may be regarded as a magnetic Quality factor (Q) value. The respective results of equations (1) and (2) above may be multiplied by the fill factor of the waveguide containing the ferrite to obtain a final permeability value. It is noted that in this discussion, the fill factor of the guide may be regarded as being approximately equal to unity.

Those of ordinary skill in the art will appreciate that the single-ridge waveguide structure may be employed to widen the bandwidth for any outside dimension of the guide. The lower impedance at the center of the ridge waveguide and the higher impedance at the outside edges of the guide act as a transformer that increases the cutoff wavelength λc while widening the guide bandwidth. As described above with reference to the folded rectangular waveguide 200 (see FIGS. 2*a*–2*b*) and the single-ridge waveguide 300 (see FIGS. 3*a*–3*b*), the RF propagation mode for the guides 200 and 300 is folded about the septa 202 and 302, respectively.

As also described above, the cutoff wavelength λc associated with the rectangular waveguide 100 may be expressed as $$\lambda c=2a, \quad (3)$$

in which "a" is the width dimension on the inside of the guide. When the rectangular waveguide 100 is folded to form the folded rectangular waveguide structures 200 and 300, the RF propagation mode curves around the region of the fold. The RF field curvature thus follows "π" conventions instead of following a straight path, as in the rectangular waveguide 100.

Accordingly, in the region of the fold of the folded rectangular waveguide, the height dimension "b" on the inside of the guide is replaced by "πb/2". The cutoff wave length λc associated with the folded rectangular waveguide may therefore be expressed as $$\lambda c=2(i\ a-b+\pi b/2),$$

or $$\lambda c=2(a+b(\pi/2-1)). \quad (4)$$

It is noted that the relatively thin septum 202 of the folded rectangular waveguide 200 (see FIG. 2*a*) is a high current carrying area, which can cause increased losses due to its reduced cross-section. By providing the crosspiece 306 to form a widened T-top on the septum 302 of the folded rectangular waveguide 300 (see FIG. 3*a*), the T configuration of the septum 302 and the crosspiece 306 can carry an increased amount of current with reduced loss. This T configuration can also lower the impedance of the folded rectangular waveguide structure.

As shown in FIG. 1*c*, clockwise and counter-clockwise alternating loops of magnetic field pass down the rectangular waveguide 100, in which the plane of the alternating loops is parallel to the broad side of the guide. On one side of the waveguide 100, the loops of magnetic field are oriented in a clockwise direction, while on the other side of the guide the magnetic field loops are oriented in a counter-clockwise direction. The rectangular waveguide 100 relies on these clockwise and counter-clockwise alternating magnetic field loops for providing differential phase shift. It is noted that in order to make use of both sides of the rectangular waveguide 100, two opposite biasing magnetic fields, one on each side of the guide, are typically required.

By folding the rectangular waveguide 100 (see FIG. 1*a*) along the propagation direction of RF energy in the guide to form the folded rectangular waveguide 200 (see FIG. 2*a*) and the folded rectangular waveguide 300 (see FIG. 3*a*), the clockwise and counter-clockwise alternating magnetic field loops come into alignment and the perceived sense of circular polarization, when viewed from the broad side of the guide, is the same. The magnetic biasing required for the guides 200 and 300 can thus be achieved using a single magnetic field passing through both channels of the guides disposed on opposite sides of the septa 202 and 302, respectively. Moreover, by bending the folded rectangular waveguide 300 (see FIG. 3*a*) along the longitudinal dimension of the guide to form the compact waveguide structure 401 (see FIGS. 4*a*–4*e*), the maximum electrical length can be achieved in the compact waveguide 401 while maintaining the magnetic field properties of the folded rectangular waveguide 300.

It is noted that both sides of the RF magnetic field propagating in the waveguide structure 401 extend toward the center of the disk 424 (see FIG. 4*a*). Both the biasing magnetic field and the applied RF magnetic field are thus localized to the center region of the guide. Moreover, by totally filling the waveguide 401 with the ferrite 440, the size of the guide is minimized and the fill factor is maximized, which in turn maximizes the variability of the ferrite permeability for enhanced control of the phase shift of signals propagating through the ferrite microwave phase shifter 400.

Figure 5:
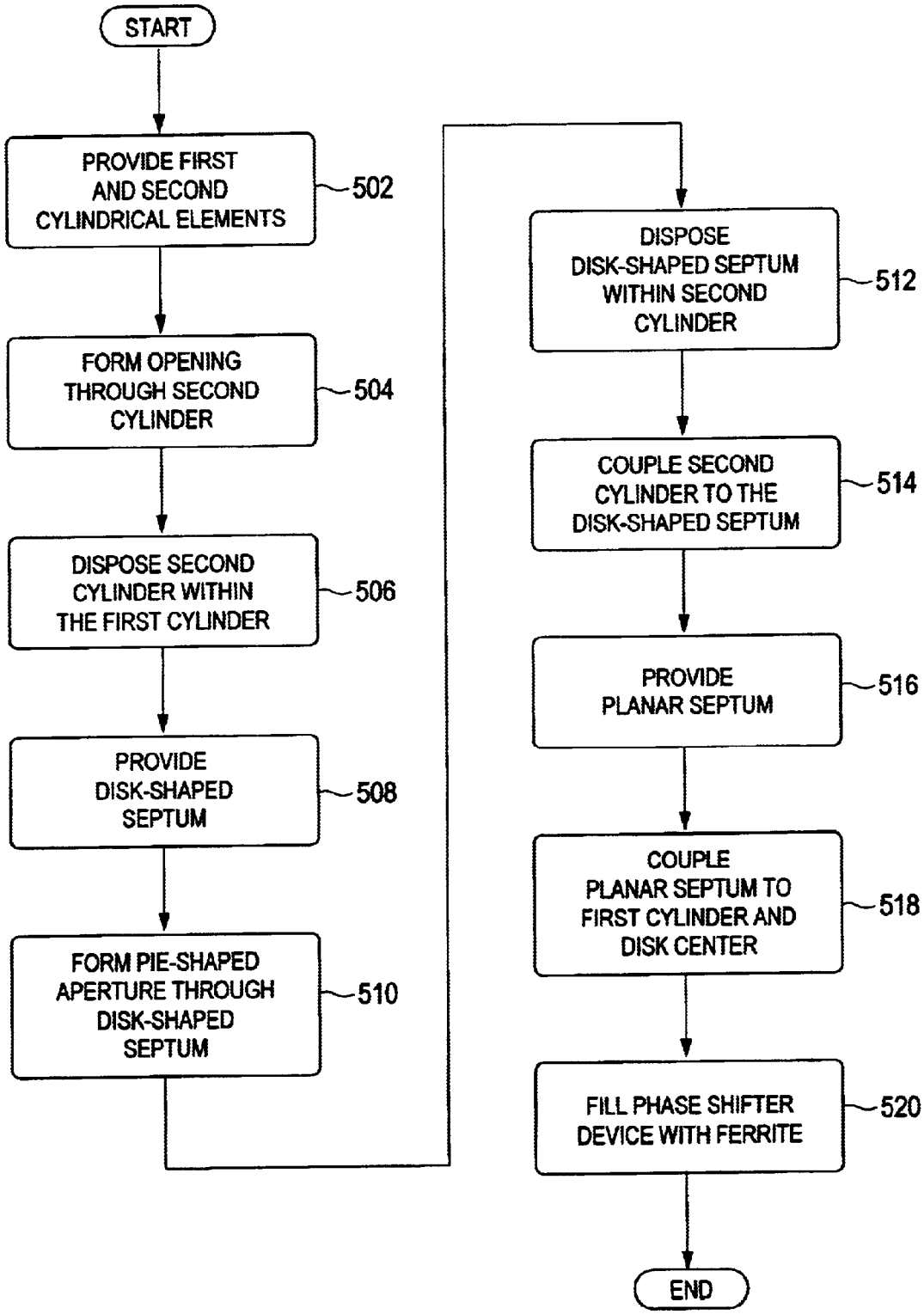
FIG. 5 is a flow diagram illustrating a method of fabricating the high power ferrite microwave phase shifter of FIGS. 4*a*–4*e*.

A method of fabricating the ferrite microwave phase shifter 400 including the waveguide structure 401 (see FIGS. 4*a*–4*e*) is illustrated by reference to FIG. 5. As depicted in step 502, first and second cylindrical elements are provided, in which the radius of the second cylinder is less than the radius of the first cylinder. Next, an opening is formed, as depicted in step 504, through the second cylinder extending the full length of the cylinder. The second cylinder is then disposed, as depicted in step 506, within the first cylinder such that the first and second cylinders have a common axis of symmetry. Next, a first disk-shaped septum is provided, as depicted in step 508. A pie-shaped aperture is then formed, as depicted in step 510, through the disk extending through the circumference of the disk and tapering to the disk center. Next, the disk is centrally disposed, as depicted in step 512, within the second cylinder such that the first cylinder, the second cylinder, and the disk share the same axis of symmetry. The inner wall of the second cylinder is then coupled, as depicted in step 514, to the circumferential edge of the disk such that the opening in the second cylinder is aligned with the pie-shaped aperture in the disk. Next, a second planar septum is provided, as depicted in step 516. The second septum is then coupled, as depicted in step 518, to the inner wall of the first cylinder and the disk at the disk center such that the second septum bisects the pie-shaped aperture and is approximately perpendicular to the plane of the disk. Finally, the ferrite microwave phase shifter is totally filled, as depicted in step 520, with ferrite. An RF magnetic field may then be transversely applied to the ferrite for controllably shifting the phase of signals propagating through the phase shifter device.

It will further be appreciated by those of ordinary skill in the art that modifications to and variations of the above-described compact high power analog electrically controlled phase shifter may be made without departing from the inventive concepts disclosed herein. Accordingly, the invention should not be viewed as limited except as by the scope and spirit of the appended claims.

What is claimed is:

1. A ferrite phase shifter, comprising:

an input;

an output;

a waveguide structure disposed between the input and the output; and ferrite material loading and at least partially filling the waveguide structure, wherein the waveguide structure includes a first substantially cylindrical element having a first radius, a second substantially cylindrical element having a length and a second radius, the second radius being less than the first radius, the second cylinder having an opening formed therethrough extending the length of the second cylinder, the second cylinder being disposed within the first cylinder such that the first and second cylinders have a common axis of symmetry, a first substantially disk-shaped septum centrally disposed within the second cylinder such that the second cylinder and the first septum share the common axis of symmetry, the first septum having a circumference, a center, and a pie-shaped aperture formed therethrough extending through the circumference and tapering to the center, the opening of the second cylinder being aligned with the pie-shaped aperture so as not to obstruct the pie-shaped aperture, and a second substantially planar septum disposed within the first cylinder such that the second septum extends from the first cylinder to the center of the second septum while bisecting the pie-shaped aperture and being approximately perpendicular to the first septum, the second septum being configured to separate the input from the output of the ferrite phase shifter.

2. The ferrite phase shifter of claim 1 wherein the ferrite material loads and totally fills the waveguide structure.

3. The ferrite phase shifter of claim 1 further including a plurality of cover portions configured to enclose the ferrite material within the waveguide structure.

4. The ferrite phase shifter of claim 1 further including means for generating and transversely applying a magnetic field to the ferrite material.

5. The ferrite phase shifter of claim 4 wherein the generating and applying means is electrically controllable.

6. A method of fabricating a ferrite phase shifter comprising the steps of:

fabricating a waveguide structure including the steps of providing a first substantially cylindrical element having a first radius, providing a second substantially cylindrical element having a length and a second radius, the second radius being less than the first radius, the second cylinder having an opening formed therethrough extending the length of the second cylinder, disposing the second cylindrical element within the first cylindrical element such that the first and second cylinders have a common axis of symmetry, providing a first substantially disk-shaped septum having a circumference, a center, and a pie-shaped aperture formed therethrough extending through the circumference to the center of the first septum, disposing the first septum within the second cylindrical element such that the first septum is centrally located within the second cylinder and the first septum and the second cylinder share the common axis of symmetry, the opening of the second cylinder being aligned with the pie-shaped aperture so as not to obstruct the pie-shaped aperture, providing a second substantially planar septum, and disposing the second septum within the first cylinder such that the second septum extends from the first cylinder to the center of the second septum while bisecting the pie-shaped aperture and being approximately perpendicular to the first septum, thereby separating an input from an output of the ferrite phase shifter; and loading and at least partially filling the waveguide structure with ferrite material.

7. The method of claim 6 wherein the loading step includes loading and totally filling the waveguide structure with the ferrite material.

8. The method of claim 6 further including the steps of providing a plurality of cover portions and disposing the cover portions on opposing sides of the waveguide structure to enclose the ferrite material within the guide.

9. The method of claim 6 further including the steps of generating and transversely applying a magnetic field to the ferrite material.

10. The method of claim 9 wherein the generating step includes electromagnetically generating the magnetic field.

* * * * *